US008512159B2

(12) United States Patent
Miller

(10) Patent No.: US 8,512,159 B2
(45) Date of Patent: Aug. 20, 2013

(54) PNEUMATIC POWERED SWING SYSTEM AND METHOD

(76) Inventor: Leslie L. Miller, Modesto, CA (US)

( * ) Notice: Subject to any disclaimer, the term of this patent is extended or adjusted under 35 U.S.C. 154(b) by 270 days.

(21) Appl. No.: 13/067,779

(22) Filed: Jun. 27, 2011

(65) Prior Publication Data

US 2011/0319181 A1 Dec. 29, 2011

Related U.S. Application Data

(60) Provisional application No. 61/344,303, filed on Jun. 25, 2010.

(51) Int. Cl.
*A63G 9/16* (2006.01)
*A63G 9/00* (2006.01)

(52) U.S. Cl.
USPC ..... 472/119

(58) Field of Classification Search
USPC ..... 472/118–125; 297/273, 284
See application file for complete search history.

(56) References Cited

U.S. PATENT DOCUMENTS 3,692,305 A * 9/1972 Allen ..... 472/119
3,794,317 A 2/1974 Barrett
4,150,820 A 4/1979 Bochmann
4,448,410 A 5/1984 Kosoff
4,491,317 A 1/1985 Bansal
5,376,053 A 12/1994 Ponder et al.
5,573,465 A * 11/1996 Kitchen et al. ..... 472/118
5,827,124 A * 10/1998 Kleimeyer et al. ..... 472/45
6,361,446 B2 * 3/2002 Lawson et al. ..... 472/119
6,875,118 B1 * 4/2005 Checketts ..... 472/119

FOREIGN PATENT DOCUMENTS

GB 2195259 A 4/1988
WO WO2004080365 A1 9/2004

* cited by examiner

*Primary Examiner* — Kien Nguyen
(74) *Attorney, Agent, or Firm* — Donald Grant Kelly

(57) ABSTRACT

Apparatus for driving a swing for an occupant of a certain mass and size where the drive mechanism includes a pneumatic power system and linkage for oscillating swing arm brackets. The power system is interconnected between the brackets and a stationary support and is self-compensating for variations in load related to natural frequency of the certain mass and wind resistance relative to occupant size. The power system includes a piston/cylinder arrangement where the piston is drivingly connected to at least one of the swing arm bracket supports and grounded to a stationary support. An automatically self-indexing valve control unit is attached relative to the piston/cylinder arrangement. The valve includes a reversing trigger arm carried by either the piston or cylinder configured to reset pneumatic flow direction with each oscillating piston stroke. The power system timed and is self-compensating for variations in natural frequency due to occupant mass and air resistance.

13 Claims, 4 Drawing Sheets

PNEUMATIC POWERED SWING SYSTEM AND METHOD

CROSS-REFERENCE TO RELATED APPLICATION

This application claims all priority benefits under 35 USC 119(e) of prior-filed Provisional Patent Application Ser. No. 61/344,303 filed Jun. 25, 2010 in the name of Leslie L. Miller, said provisional patent application in its entirety being incorporated herein by reference thereto and for all purposes, as if fully set forth herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

SEQUENCE LISTING OR COMPUTER PROGRAM LISTING

Not Applicable

BACKGROUND OF THE INVENTION

1. Field of the Invention

The detailed disclosure that follows herebelow generally relates to recreational and therapeutic swings and more particularly to air or other pneumatically powered swing systems suitable for disabled individuals or invalids.

2. Description of Related Art

Swings are commonly used to provide therapeutic movement and/or exhilaration for toddlers and adult people of all ages; particularly for physically or intellectually challenged individuals. In the latter case, swing therapy holds potential for an enhanced sense of well being. Commonly known "powered" swing systems are driven by electric motors, battery source, or varied types of mechanical crank systems.

Most swings large and small are simply pushed manually by a companion, playmate, caretaker, parent or others. For example, at institutional caretaking facilities, manually driven swings generally demand attendants dedicated to each swing system operation. These can be time consuming and budget-intensive—not to mention physically exhausting. Converting to electric motors and battery powered units for operating swing systems can be costly, not only for system investment but also in terms of human capital and operational expenses.

Electric motors in general introduce an obvious safety hazard with respect to typically metal swing frames. Batteries are subject to repeated depletion wherein the swing's motion and associated benefits diminish or cease, thus demanding prompt battery replacement if swing motion is to be resumed. Mechanical crank driven swings tend to be a laborious nuisance since active crank cycle time is limited, and because the crank mechanism itself can be annoyingly noisy and subject to jamming. Besides, due to liability issues such swing drive systems are believed to no longer exist on the commercial market.

Currently available swing drives have weight limitations. Motor, battery or crank-powered swings are usually assigned to light duty only and are wholly inadequate for supporting and moving (i.e., swinging) swing seat occupants greater in size and mass than typical infants. Weight or mass is a consideration in terms of swing design for heavier swing seat occupants, particularly with regard to natural frequency effects. Overall size of passengers can be an issue with respect to air resistance. Likewise, typically lightweight construction of conventional battery or crank swings cannot withstand stress inherent in extended swinging.

Thus, it is understandable that existing swing systems involving electric motors, cranks and battery-powered operation are less desirable since they can be expensive and/or inadequate for maintaining satisfactory swinging motion where extended utilization and/or heavier swing occupants are concerned.

Not only is swing equipment costly, but significant institutional staff or family/friend labor often is dedicated to providing adequate swing motion for swing seat occupants who are disabled or otherwise physically and/or intellectually challenged individuals. Typically, hands-on assistance in the form of direct, manual pushing may be necessary several times each minute. Moreover, existing swings with motor or battery drives require tedious power/frequency adjustment for occupants of different mass/weight and size.

Continuous manual readjustment of a swing's power drive system from one occupant to the next can be a daunting task for caretakers or healthcare providers—presenting not only physical demands but also cognitive challenges of managing control variables factoring occupant weight, power levels and frequency. All this, added to the many other daycare worker duties in a therapy or caretaking facility can be overwhelming. Too often, the unfortunate result is considerably limited or non-existent swing therapy for the disabled or challenged.

Representative examples of existing, powered swing systems include: Barrett's U.S. Pat. No. 3,794,317 presenting a crank-wound spring motor; Bochmann's U.S. Pat. No. 4,150,820 teaches a motorized swing system with a rechargeable battery drive to be enjoyed by a relatively small child; Kosoff's electrically powered baby swing shown in U.S. Pat. No. 4,448,410, employing a battery powered DC motor and featuring a rotating eccentric weight at top to cause the oscillating motion.

Still more examples are: Bansal's U.S. Pat. No. 4,491,317 presenting an infant swing driven in its oscillating motion by a battery powered spring compensated solenoid; Arthur J. Record's British patent document GB2195259 presenting a swing configured to accommodate wheelchair bound persons; Ponder et al., in U.S. Pat. No. 5,376,053 presenting a remotely operated motorized swing having an electric drive which can be controlled directly by the swinging patient; Foehl's published PCT patent application WO02004080365 teaches a device for moving and caring for the totally disabled.

The above mentioned documented swing systems are subject to a variety of problems ranging from occupant mass/size limitations to relatively rapid power source exhaustion. None offers the convenience, effectiveness and control of the novel air powered swing system and method described herein. A pneumatically or air powered swing of the type described herebelow has been thoughtfully designed and found to effectively address the myriad of problems associated with conventionally powered swings. It is asserted that the presently disclosed innovation will prove invaluable to the trades and others, particularly with respect to caring for disabled individuals.

BRIEF SUMMARY OF THE INVENTION

As suggested hereabove, the pneumatically powered swing system and method as presently presented overcome problems associated with conventional powered swing systems. The disclosed system supports heavier weights/masses and has durability to withstand the stress of additional weight as compared to infant swings. The pneumatic powering apparatus is substantially self-compensating to the natural frequency of the mass of the occupant placed in the seat, indexing its power drive position at the end of each stroke (cycle) by a unique gas flow control valve arrangement.

Oscillation motion of the pneumatic power drive apparatus of the swing power system is easily initiated with an initial manual push of the seat or occupant (by essentially untrained personnel). Once swinging action is initiated, the oscillating swing seat carrying its occupant may be left to its powered motion without intervention for an indefinite period or for a period defined by a pre-programmed timer unit. With, or without, the timer unit, this novel swing powering system will run essentially continuously without assistance.

As noted above, a basic swing seat support structure referred to herein may be embodied in a variety of configurations. For example, it may be the ubiquitous "stand-alone-swing-set" configured as a generally horizontal tubular steel rail which is fixed to laterally supported angularly disposed support legs of similar or equivalent material. At least one seat is suspended by support media such as ropes, chains and the like from the tubular steel rail.

Another swing system example would have the swing seat suspended from a building overhang, or directly from brackets on an overhead ceiling or cantilevered structure . . . . Essentially any swing support configuration can be driven by the unique power system discussed herebelow. In other words, for purposes of the present disclosure, the swing support hardware is presumed to embody a range of equivalent configurations and materials.

A principal key to the self compensating nature of the presently disclosed system is that it is pneumatically powered, thus eliminating need for frequency adjustment for differing masses supported in the swing's seat carriage. A general adjustment (high, medium and low) may be useful in fine-tuning to achieve a proper swing experience (i.e., not undesirably aggressive) depending on the mass of the swing seat occupant.

An additional benefit to the unique disclosure presented herein is that it is not electrically powered and does not conduct dangerous electrical energy from the drive system to the swing's framework vicinity. Obviously, this affords an additional safety margin against potential shock. The system presently disclosed may incorporate a timing mechanism to avoid occupant motion sickness due to long term operation. The inventive system's capacity to begin operation almost immediately dramatically reduces the time typically required by known mechanical cranks and battery units to establish a satisfactory swinging movement.

Objectives of the presently disclosed swing-drive power system include provision of a system and method for delivering a gentle propelling action enabling individuals of any age, weight and physical/mental condition to partake in a swing-riding experience for personal enjoyment and therapeutic well-being.

This system and its method of use enable continued and extended swinging action, while relieving swing attendants (staff) from duties of close monitoring and supplementing swing action assistance. This of course measurably reduces labor requirements in home, daycare, institutional and associated facilities. Importantly, the swinging action provided hereby may be stopped at any time.

A still further objective is to afford continuous, economic swing activity automatically monitored by an alternative timing device for pre-set shut-down. An objective of such a timing device would include avoidance of motion sickness brought on by excess swinging activity. Use of an air or other pneumatic power system drive with tubing, e.g., polyurethane or nylon, purposefully avoids electricity-fed operations that could cause shock or burn injury to the occupant (i.e., the individual mounted on swing seat attached to a metal frame) and to nearby staff attendants. Batteries and their attendant shortcomings discussed hereabove also are avoided.

The pneumatic power system of the disclosure presented herein is self-indexing, allowing a broad range (high, medium, low) to generally adjust to differences swing occupant mass (influencing the natural frequency of the swing's oscillation) and overall size (influencing the effects of air resistance with respect to both directions of swing motion. The present invention described herein holds the advantage of avoiding swing power unit overloading. The overall "system" may be viewed as encompassing seat and attendant attachment elements, support media, carriage, table, sock, tube, or other supporting structure to carry the occupant to be swung. The system may also be defined as the power drive and pneumatic flow controls, and the method of operation thereof.

Furthermore, it is an object of this application to illustrate a fully functional and enabling embodiment while broadly encompassing unique structure and methodology used to swing individuals who cannot adequately or satisfactorily swing themselves.

DETAILED DESCRIPTION

Figure 1:
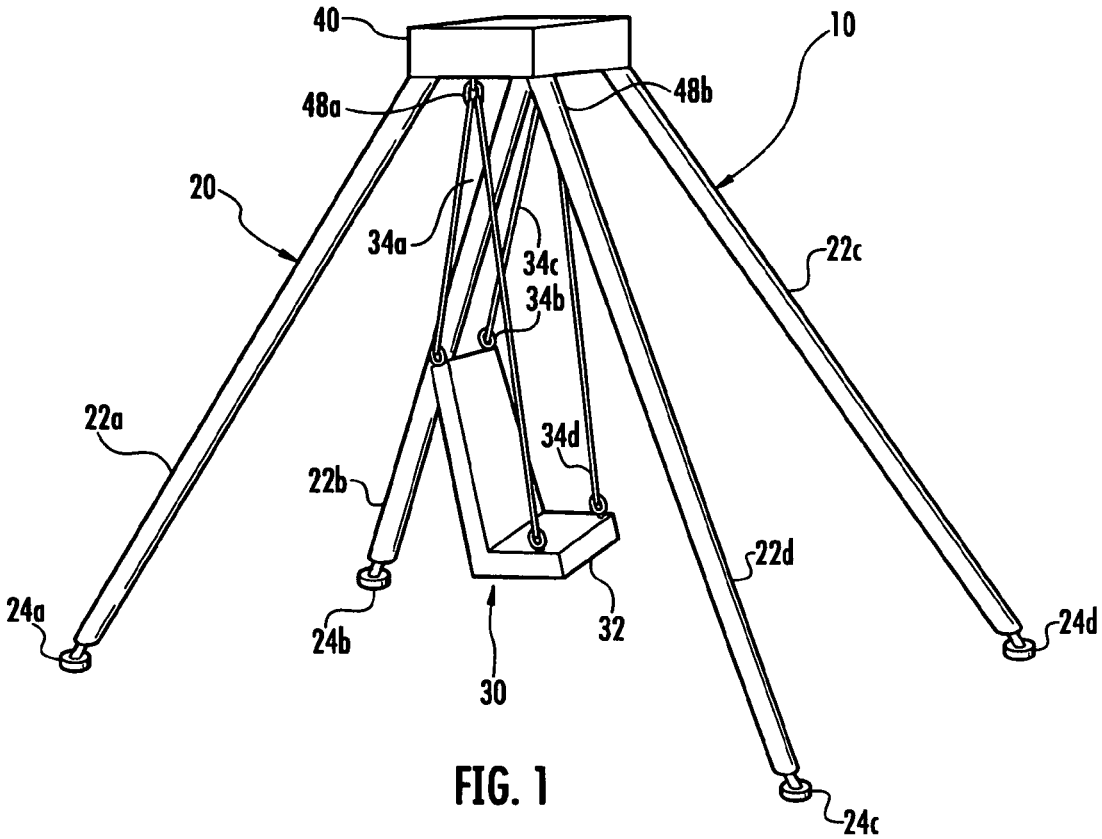
FIG. 1 is a side perspective view of the disclosed system illustrating environs and components associated with the pneumatic powered swing system.

Illustrated in FIG. 1, by way of example only, in FIG. 1, is a stand-alone-swing system 10 comprising a stationary supporting frame 20 from which is suspended swing seat unit 30 including seat 32 (occupant not shown). Swing seat unit 30 is suspended from above by ropes 34*a*, 34*b*, 34*c* and 34*d* which are secured to brackets to be described. Of course, seat suspension media may be selected from the group consisting of ropes, chains, wires, cords, and lines, without departing from the spirit and scope of the invention claimed. Further, as discussed herein in more detail, the swing seat 32 can have overhead support structures other than a free-standing frame 20. Seat 32 could also be in the form of a chair (e.g., wheelchair) supported by a platform, which in turn would be suspended by media from above as noted above.

For brevity, but in no way intended as limiting the scope of claims appended hereto, the suspension media are hereafter referred to as "ropes." Said ropes 34*a-d* are secured in a conventional manner (e.g., by conventional connector links 48*a*, 48*b*, respectively) to swing arm brackets 46*a* and 46*b* located within or adjacent stationary, relatively fixed top support unit 40.

A pneumatic power drive apparatus 50 (not visible in FIG. 1, but clearly depicted in FIG. 2) is housed or enclosed within relatively stationary support unit 40 where it is fixedly attached. As will be explained, suspended swing seat 32 oscillates repetitively along an arc as power unit 50 propels swing arm brackets 46*a*, 46*b*. These brackets 46*a*, 46*b* or their equivalents represent the interface of the swinging and power operations now to be described in detail.

Swinging action of swing seat 32 and its seated occupant is powered by a pneumatic power drive apparatus 50. This pneumatic power drive apparatus is operatively interconnected generally between said swing arm brackets 46*a*, 46*b* and stationary or fixed support 40. The power drive apparatus can include a pneumatic cylinder 56 connected at its first end to said stationary support 40 and receiving at a second end thereof a piston rod 62 for extending and retracting motion therein.

Note that since cylinder 56 must have freedom of movement to an extent affording pivoting during its swing oscillation operation. To this end, cylinder 56 may be affixed at its first end via pivot pin connection 54 and pivot bracket 52 relative to stationary top support unit 40 (or connected to other conveniently adjacent stationary structure). Piston rod 62 includes an outer working end viewed in FIGS. 2 and 3 indirectly connected via bolt 70 and nut 71 to swing arm bracket 46*a*. Swing support brackets 46*a* and 46*b* are depicted as drivingly interconnected by substantially horizontal oscillator shaft 44 to be further discussed herebelow. Power drive apparatus 50 is regulated and controlled by pneumatic system 200 schematically depicted in FIG. 4. The term pneumatic, in its present sense, is intended to include air and other gaseous fluid which may adequately serve in a manner equivalent to air. The terms air and pneumatic are used interchangeably herein.

Figure 2:
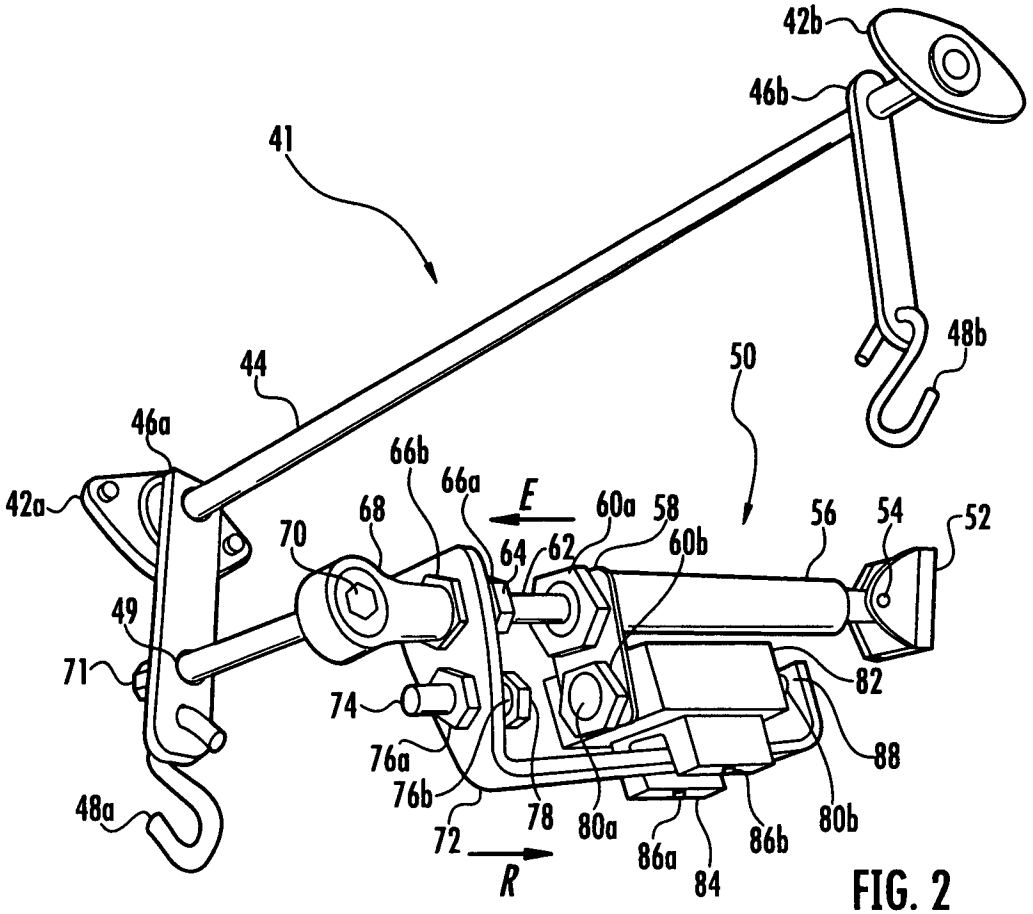
FIG. 2 is a side perspective of the pneumatic power drive apparatus as viewed from below and with housing enclosure and other specified elements omitted for clarity of illustration.

While the swing unit per se may take a variety of forms, it is believed useful to establish a swing environment relative to the present disclosure by generally describing the swing and suspension configuration depicted in FIGS. 1 and 2. Self-powered swing 10 is seen to include frame 20 with four depending legs 22*a*, 22*b*, 22*c*, 22*d* sufficiently spaced to maintain the suspended chair or seat unit 30 in a secure disposition on the ground or floor as it rests atop non-slip feet 24*a*, 24*b*, 24*c* and 24*d*. This secure disposition may vary depending on the nature of the swing and whether the swing will be utilized to support larger individuals (e.g., adults) or smaller individuals. In any case, the frame unit 20 presents a stable and reliable "footprint" such that a seat 32 occupant will not fall or tip while swinging takes place.

Selection of tubing (or alternative profile structure) for frame legs 22*a*, 22*b*, 22*c*, and 22*d* can be made from any number of selected commercial grade tubing or other type of suitable rod element, material. Swing seat 32 may be chosen from any number of seating units commonly available in the marketplace. In fact, multiple seat sizes and configurations can be kept in reserve to accommodate varied seat occupant mass and sizes. Likewise, top support unit 40 may be made of steel, aluminum or other suitably fabricated material as long as the resulting structure is of sufficient weight, strength and stability to withstand a vast multitude of swinging repetitions desired by the manufacture and/or expected by the swing seat occupant.

Returning now to swing suspension 41, FIG. 2 shows swing suspension journal bearings 42*a*, 42*b* securely anchored to support 40. These bearings 42*a*, 42*b* may be bolted in place or otherwise reliably affixed to support 40 (via welding, riveting or the like), and are transversally interconnected by substantially horizontal oscillator shaft 44 therebetween. This oscillator shaft 44 supports the swing seat or unit 30 via brackets or swing arms 46*a*, 46*b* therebelow to be driven by pneumatic power drive apparatus 50 in the following manner.

As briefly referenced above, spaced-apart swing arms or brackets 46*a* and 46*b* are rigidly interconnected substantially at their upper ends to oscillator shaft 44 so as to depend therefrom. Said brackets or arms 46*a*, 46*b* removably support swing suspension hooks 48*a* and 48*b*, respectively, located substantially at lower ends thereof. Arm 46*a* may be directly driven by the pneumatic power system as described. Inasmuch as hooks 48*a*, 48*b* may have alternative equivalent connectors substituted therefor, said hooks 48*a*, 48*b* should be considered mere examples of possible configurations and in no way limiting any claims to such assembly.

Of course, piston rod 62 reciprocates in its normal working strokes within cylinder 56, and directly drives swing arm bracket 46*a*. Thus, swing arm bracket 46*b* is indirectly driven through a rigid interconnection to oscillator shaft 44. This driving action sets into action swing unit 30 in an oscillating motion.

Oscillation is maintained by pneumatic power system 50 fixedly located within top support unit 40. A first (forward) movement of brackets 46*a*, 46*b* serves to push seat 32 outward in one direction and then, with second (rearward) movement, retracts swing seat 32 in an opposite direction. The repetitively reversing action is registered (self-indexed), by reason of reaching the end of a propelling stroke in either direction.

Figure 3:
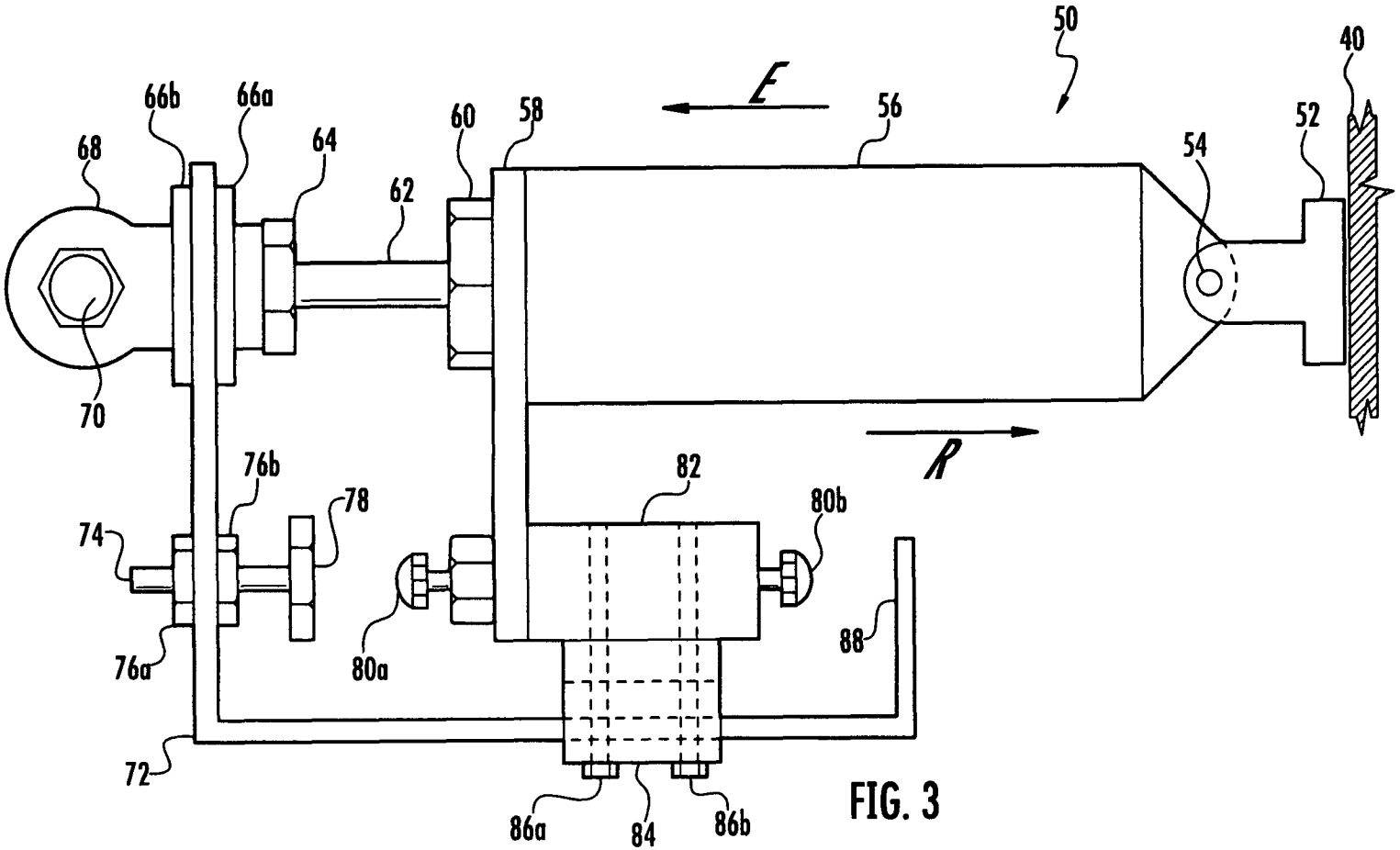
FIG. 3 is a side elevation view of the pneumatic power drive apparatus similar to the perspective of FIG. 2, omitting specified elements for sake of clarity.

Mounting nut 60*b* (FIG. 2) holds control valve unit 82 to mounting bracket 58, in turn held to cylinder 56 by nut 60*a*. Control valve unit 82 is actuated by outward extending contact points in the form of first and second valve reversing elements 80*a*, 80*b* (FIGS. 2,3). In the interest of illustration simplicity, external control valve unit 82 is presented herein without its well known pneumatic feed/return lines and requisite port details (e.g., pressure port, work port, exhaust port and so forth), so as not to obstruct the view of valve-controlling trigger arm 72 and its associated parts with respect to these valve reversing elements 80*a*, 80*b*.

Pneumatic lines or tubing placement (not shown) is notoriously known by the skilled artisan within in the industry and such lines may be positioned according to functional performance requirements and/or environmental conditions such as space availability. For instance, control valve unit 82 as viewed in FIGS. 2, 3 could include three lateral ports along its exposed side. Typically, these ports would comprise two outlets separated by an inlet, all communicating via an internal spool valve mechanism (also not shown) and would further include a pair of ports on an opposite side of valve unit 82. The latter ports (not shown), of course, will communicate respectively with opposite ends of cylinder 56 to drive piston rod 62 in its opposite strokes. The internal workings of reversible valve units are notoriously well known to the skilled artisan.

Trigger arm 72 is mounted adjacent to the rod end 68 by mounting nuts 66*a*, 66*b*. Trigger arm 72, of course, moves forward (i.e., away from its connection to top support unit 40) as cylinder rod 62 extends in direction E, subsequently retracting backward in direction R as cylinder rod 62 retracts. Trigger arm 72 is directionally restrained or guided throughout repeated extension/retraction motion by trigger arm guide 84 affixed to control valve unit 82 by bolts 86*a*, 86*b*.

Trigger arm 72 includes a pair of contact points (or stops) 78 and 88 respectively configured for contact with the aforementioned valve reversing elements 80*a*, 80*b*. Trigger arm 72 carries push bolt 74 (held by associated lock nuts 76*a*, 76*b*) with contact point 78 in general alignment with valve reversing element 80*a*. Similarly, trigger arm 72 contact point 88 is in general alignment with valve reversing element 80*b*. Valve reversing is actuated with the sequential contact by contact points 78/80*a* and 88/80*b*. Other equivalent arrangements of course could be arranged for this sequential valve activation within the scope of the present invention defined in the claims.

Note that cylinder 56 conceivably could include an internal control valve (operating generally the same as the described external control valve unit 82) depending on pressure level requirements and system design capacity. If this were the case, the valve control trigger elements or their functional equivalents would be suitably arranged within the cylinder 56 housing, or included within structure suitably associated therewith. Optional selection of internal and external pneumatic controls is well known in the mechanical power system field.

As explained, power unit 50 is affixed or grounded for leverage to top support unit 40. Swing unit 30 is drivingly connected to power unit 50 by attaching drive bolt 70 through hole 49 on bracket 46*a* (see FIG. 2) where drive bolt fastener 71 interlocks the drive bolt 70 and bracket 46*a*. As the cylinder rod 62 fully extends (in direction E indicated in FIG. 3), trigger arm contact point 88 is engaged by valve reversing element 80*b* which shifts an inner sliding spool system of. Pneumatic pressure is automatically and substantially instantly reversed in cylinder 56 causing rod 62 to immediately retract (in direction indicted as R, FIG. 2).

When rod 62 is fully retracted, contact point 78 shifts control valve unit 82 by pushing valve reversing element 80*a*. Rod 62 again changes its direction with another power stroke. Swing movement may be initiated by a manual push by an attendant. Once the power unit 50 is activated, and swing seat 30 oscillating movement is underway, it will continue swinging for an extended period of time. Swing 10 and its passenger remain self-propelled in forward (piston extended) and reverse (piston retracted) motion until the system is shut down. A timer unit can be employed to control a swinging cycle.

Figure 4:
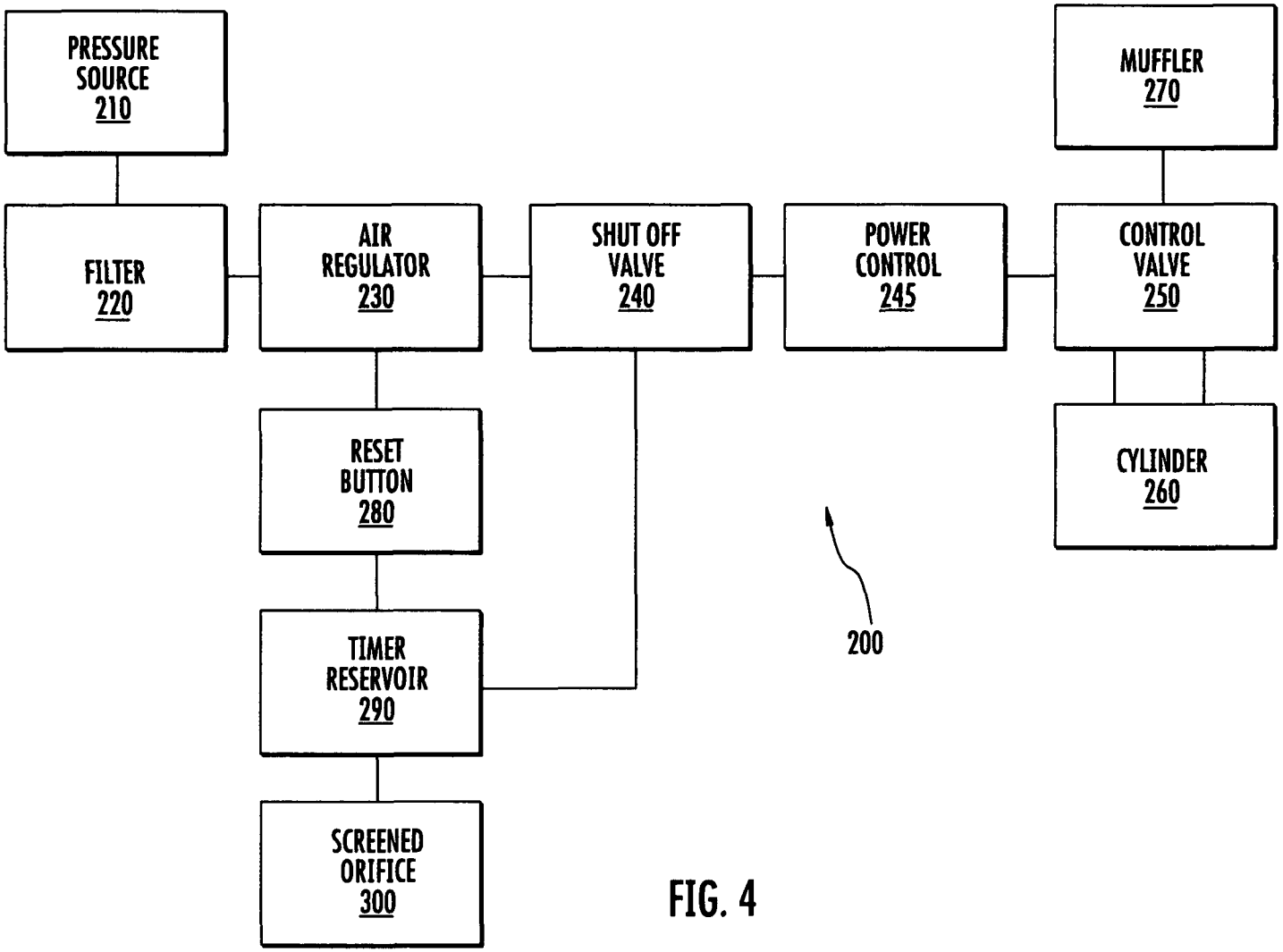
FIG. 4 is a block/flow diagram depicting the overall pneumatic operating system and its unique control features.

To facilitate understanding of the overall pneumatic system 200 for operation of power unit 50, attention is directed to schematic FIG. 4 presented in the form of a block diagram. The pneumatic operational system 200 components include operational pressure source 210 which could be an air compressor unit, pressurized CO2 tank (not shown) located reasonably near swing set unit 10 or perhaps at a remote location such as a garage or other nearby out-building. Other important components operationally linked within the pneumatic system 200 are: filter 220; primary pressure regulator 230; shut-off valve 240; power control 245; control valve 250; cylinder 260; muffler 270; reset button 280; timer reservoir 290; and screened orifice 300.

More specifically, block/flow diagram schematic FIG. 4 relates to pneumatic system 200 and how it serves to propel swing seat unit 30 in a predictably controlled manner. Air fed from pressure source 210 passes through filter 220 and system pressure is set by the air pressure regulator 230. The regulator 230 predetermines the maximum force applied to the air cylinder 56.

A secondary function of pressure regulator 230 is to provide a constant pressure level so that, when reset button 280 is activated, the timing function is replicated. Air flow pressure communicates through shut-off valve 240. Shut-off valve 240 serves to shut down swinging operation at the end of a pre-set time period to prevent motion sickness from surplus swing activity.

Pressurized air proceeds to (schematically designated) control valve 250 (corresponding to unit 82 in representational schematic FIG. 2 and FIG. 3) where it is directed to the appropriate end of cylinder 260 (or 56, see FIG. 2 and FIG. 3) indexed by trigger arm 72 (see FIG. 2 and FIG. 3) in relation to the position of swing seat unit 30 in its typical swinging arc. Control valve 250 directs exhausted air from cylinder 260 to muffler 270. This muffler 270 may take a variety of forms, and is purposed to reduce the typically sharp exhaust sound to a relatively soft pulse of air when released to atmosphere.

Screened orifice 300 provides a controlled leak for timing management. Power control 245, if needed, provides a means of matching cylinder 260 pressure to the weight of an individual carried in the swing 30. This can prevent or control aggressive over-swing. The power control 245 can be infinitely adjustable up to the pressure level of the air regulator 230.

Further included is a timing device also explained with reference to block diagram FIG. 4. Reset button 280, when pushed, charges the timing reservoir 290 to the level preset by pressure regulator 230. When the timing reservoir pressure drops to a predetermined level, it automatically causes a shift in the position of the shut-off valve 240 to close off pneumatic pressure from control valve 250. This, in turn, ceases the swing seat 30 propelling work performed by the cylinder 260, thus stopping swinging operation when a pre-selected time period expires.

Reset button 280 can be pushed before the power unit 50 stops, allowing it to repeat running through the pre-set time period. If the reset button is not activated, the swinging operation diminishes slowly, as gravity eventually brings swing 30 to a complete stop in an "at rest" position at the lowest point of swing 30 arc during its oscillation movement.

Once the system components described hereabove are procured and assembled in operative relationship and power system 50 is interconnected to pneumatic pressure feed from one or more ordinary pneumatic fluid units, operation of swing 10 as suggested in FIG. 1 may commence. With air compressor connection achieved and an occupant seated in swing seat 30, a monitoring attendant may press (engage) reset button 280 and manually initiate the arcing swinging motion by pushing swing seat unit 30 (as illustrated in FIG. 1) sufficiently high to activate pneumatic drive system 50. Optionally as desired, the monitoring attendant may push the swing in a non-powered mode (without engaging the pneumatic drive system 50) simply by not engaging reset button 280.

An occupant seated in the swing seat 30 will experience continuous swinging motion imparted by the drive system 50 until the timer shuts down the pneumatic drive system 50, or until the monitoring attendant decides to manually stop the swing motion.

By way of example only, and according to guidance of physical therapists, a typical timed period between monitoring observations is about fifteen to twenty minutes, but could be somewhat more or less depending on system design. This method of operation is ideal for families with normal or challenged children. It also is ideal for daycare facilities for the disabled or otherwise, including rehabilitation units, institutional care units, or elsewhere to help entertain, provide motion for, and otherwise calm patients who cannot or are unable to propel themselves in the action of swinging and thus enjoy the feeling the air blowing by as they swing. A sense of comfort from a swinging motion is universally known and frequently recommended by therapists and parents worldwide as, to a great extent, essentially replicating an infant's calming experience.

Although the foregoing description makes reference to a number of specific features, these should not be construed as limiting the scope of the invention claimed herein. Instead, the subject invention described as an apparatus and its method of use should be viewed as susceptible of modification, combinations and alterations. Accordingly, claims presented herein are to be considered as covering all such modifications, combinations, alterations, and equivalents thereof within the spirit and scope of the present invention.

What is claimed is:

1. A pneumatic power system for driving a swing set for individual occupants of differing mass and size, said system including at least one swing arm bracket for delivering repetitive oscillating movement to a suspended swing set seat, said system further characterized as including:

a pneumatic pressure supply source for delivering pressurized fluid force to said pneumatic power system;

a power drive apparatus for converting said pressurized force to oscillating mechanical movement, said power drive apparatus operatively interconnected between said swing arm and a stationary support;

said power drive apparatus further characterized as being self-compensating for system load;

whereby control of said oscillating mechanical movement imparted to said at least one swing arm by said power drive apparatus is self-compensating to a natural frequency of the occupant mass and size related air resistance.

2. A pneumatic power system for driving engagement with at least one swing arm bracket for providing repetitive oscillating movement to a powered swing set for individual occupants of differing mass and size, said pneumatic power system comprising:

a pneumatic power drive apparatus operatively interconnected between said swing arm bracket and a stationary support;

said power drive apparatus further defined as including a pneumatic cylinder connected at a first end thereof to said stationary support and receiving at a second end thereof a piston mounted for extending and retracting motion therein;

said piston having an outer working end operatively connected to said at least one swing arm bracket so as to drivingly oscillate said at least one swing arm bracket;

a reversible control valve unit fixedly attached to said pneumatic cylinder second end, said control valve unit includes valve reversing elements at first and second ends thereof for automatically reversing said control valve;

a reversible control valve controlling trigger arm affixed to said piston so as to extend and retract therewith;

said valve controlling trigger arm including first and second contact points respectively in substantial alignment with said valve reversing elements at said first and second ends of said control valve unit;

whereby reciprocal movement of said piston along with its associated trigger arm brings said first and second trigger arm contact points into sequential engagement with said valve reversing elements to automatically reverse directional movement of said control valve unit, imparting reversed directional force on said at least one swing arm bracket so as to automatically compensate for a natural frequency of occupant mass and size related air resistance.

3. The pneumatic power system of claim 2, further defined as including:

a pair of swing arm brackets interconnected by a relatively horizontal oscillator shaft so as to move in unison when said at least one swing arm bracket is drivingly oscillated by said piston outer working end;

each of said interconnected swing arm brackets is configured for attachment to an oscillating swing system.

4. The pneumatic power system of claim 2, further defined as including:

a primary pressure regulator for establishing maximum pressure in said pneumatic power system;

a secondary pneumatic pressure control for adjusting operating pressure corresponding to system load;

whereby adjustments can be made to match cylinder pressure to mass and size of an occupant carried in a swing system.

5. The pneumatic power system of claim 4, further defined as including:

a timer reservoir unit, reset button and shut off valve operationally interconnected to said primary pressure regulator;

whereby engagement of said reset button charges said timing reservoir to a preset primary pressure regulator level and as timing reservoir pressure drops to a predetermined level shut off valve closes off pressure from said control valve to stop said oscillating movement.

6. The pneumatic power system of claim 2, further characterized by:

said reversible control valve unit includes a trigger arm guide for directionally constraining said trigger arm as it extends and retracts with said piston.

7. A pneumatically powered swing set system including:

a swing seat for supporting an occupant of certain size and mass for oscillating swinging motion, including a fixed support for said seat;

a pair of interconnected swing arm brackets attached to said fixed support and interconnected by a relatively horizontal oscillator shaft so as to move in unison when said at least one swing arm bracket is drivingly oscillated by said piston outer working end;

said swing seat is attached to said swing arm brackets by seat suspension media;

a pneumatic power system for driving engagement with at least one swing arm bracket for providing repetitive oscillating movement to said swing arm bracket;

a pneumatic power drive apparatus operatively interconnected between said swing arm bracket and said fixed support;

said power drive apparatus further defined as including a pneumatic cylinder connected at a first end thereof to said fixed support and receiving at a second end thereof a piston mounted for extending and retracting motion therein;

said piston having an outer working end operatively connected to said at least one swing arm bracket so as to drivingly oscillate said at least one swing arm bracket and said suspension media therewith;

a reversible control valve unit fixedly attached to said pneumatic cylinder second end, said control valve unit includes valve reversing elements at first and second ends thereof for automatically reversing said control valve;

a reversible control valve controlling trigger arm affixed to said piston so as to extend and retract therewith;

said valve controlling trigger arm including first and second contact points respectively in substantial alignment with said valve reversing elements at said first and second ends of said control valve unit;

whereby reciprocal movement of said piston along with its associated trigger arm brings said first and second trigger arm contact points into sequential engagement with said valve reversing elements to reverse directional movement of said control valve unit, imparting reversed directional force on said at least one swing arm bracket and said seat suspended therefrom in a way that control of said seat movement is self-compensated to a natural frequency of the occupant mass and to size related air resistance.

8. The pneumatically powered swing system of claim 7, further defined as including:

a primary pressure regulator for establishing maximum pressure in said pneumatic power system;

a secondary pneumatic pressure control for adjusting operating pressure corresponding to system load;

whereby adjustments can be made to match cylinder pressure to the mass of an occupant carried in said swing seat.

9. The pneumatically powered swing of claim 8, further defined as including:

a timer reservoir unit, reset button and shut off valve operationally interconnected to said primary pressure regulator;

whereby engagement of said reset button charges said timing reservoir to a preset primary pressure regulator level and as timing reservoir pressure drops to a predetermined level shut off valve closes off pressure from said control valve to stop the oscillating movement of said pneumatically powered swing system.

10. The pneumatically powered swing system of claim 7, further characterized by:

said reversible control valve unit includes a trigger arm guide for directionally constraining said trigger arm as it extends and retracts with said piston.

11. A method of pneumatically powering a swing system for an occupant of certain size and mass, said method including the steps of:

providing a fixed support for said swing system;

providing a swing seat accommodating said occupant for an oscillating swing session;

attaching a pair of interconnected swing arm brackets to said fixed support;

suspending said swing seat from said swing arm brackets;

providing a pneumatic power system for driving engagement with said swing arm brackets to alternatively extend and retract movement to said swing arm bracket, said swing seat and said occupant accommodated therein;

driving said swing arm brackets by said power system in an oscillating motion;

providing an automatic control for automatically reversing said power system direction at the end of each extend and retract movement;

such that said control for reversing said power system is self-compensating to a natural frequency of the occupant mass and size related air resistance so as to afford said occupant with a continuous self-indexed swing session.

12. The method of claim 11 further including the steps of:

providing a primary pressure regulator;

employing said regulator to initially establish maximum operating pneumatic pressure for powering said swing system;

providing a secondary pneumatic pressure control for finitely adjusting said operating pressure to accommodate for actual load due to said occupant mass and wind resistance.

13. The method of pneumatically powering a swing system set forth in claim 12 further including the steps of:

providing said system with a timer reservoir unit, reset button and shut off valve operationally interconnected to said primary pressure regulator;

activating said reset button to charge said timing reservoir to a preset primary pressure regulator level;

setting said timing reservoir to correspond to a certain time period for said swing session;

operating said pneumatically powered swing system until said timing reservoir pressure drops to a level corresponding to expiration of said certain time period;

automatically closing said shut off valve ceasing pneumatic power to the system.

* * * * *